US011807930B1

(12) United States Patent
Zheng et al.

(10) Patent No.: US 11,807,930 B1
(45) Date of Patent: Nov. 7, 2023

(54) VACUUM SOLUTION AND AGING TREATMENT PROCESS FOR IMPROVING HIGH-TEMPERATURE PLASTICITY OF GH4738 RINGS

(71) Applicant: University of Science and Technology Beijing, Beijing (CN)

(72) Inventors: Lei Zheng, Beijing (CN); Hongliang Liu, Beijing (CN); Xin Zhao, Beijing (CN); Jian Dong, Beijing (CN); Ye Meng, Beijing (CN)

(73) Assignee: University of Science and Technology Beijing, Beijing (CN)

( * ) Notice: Subject to any disclaimer, the term of this patent is extended or adjusted under 35 U.S.C. 154(b) by 0 days.

(21) Appl. No.: 17/979,007

(22) Filed: Nov. 2, 2022

(51) Int. Cl.
*C22F 1/10* (2006.01)
*C22F 1/02* (2006.01)

(52) U.S. Cl.
CPC . *C22F 1/10* (2013.01); *C22F 1/02* (2013.01)

(58) Field of Classification Search
CPC ..... C22F 1/10; C22F 1/02
See application file for complete search history.

(56) References Cited

FOREIGN PATENT DOCUMENTS

CN 1890395 A 1/2007
CN 103103465 A 5/2013
CN 105798539 A 7/2016
CN 109306399 A 2/2019
CN 110337500 A 10/2019
CN 111069496 A * 4/2020 ..... B21B 37/74
CN 112593170 A 4/2021
(Continued)

OTHER PUBLICATIONS

Li Ning, et al., The Effect of Different Cooling Speeds after Solution Treatment on the Microstructure and Properties of GH4141 Alloy, Proceedings of the 13th China Superalloy Annual Conference, pp. 46-49.

(Continued)

*Primary Examiner* — Anthony M Liang
*Assistant Examiner* — Jacob J Gusewelle
(74) *Attorney, Agent, or Firm* — Bayramoglu Law Offices LLC

(57) ABSTRACT

A vacuum solution and aging treatment process for improving high-temperature plasticity of GH4738 rings includes: heating a GH4738 ring to 1020° C. to 1030° C. in a vacuum environment; injecting nitrogen; subjecting the GH4738 ring to aging treatment at 740° C. to 750° C.; and taking out and air-cooling the GH4738 ring. The method realizes the uniform distribution of the intragranular γ' precipitates and the intergranular $M_{23}C_6$ carbides in the GH4738 ring after heat treatment. The elongation and area reduction of the alloy ring stretched at 540° C. after heat treatment are 30% and 34% respectively, which are 25% and 36% higher than those before process optimization respectively; and that at 760° C. are 49% and 70% respectively, which are 32% and 27% higher than those before process optimization respectively. The index requirements can be fully met. This process is applicable to GH4738 rings, which have a high requirement on high-temperature plasticity after heat treatment.

2 Claims, 1 Drawing Sheet

(56) References Cited

FOREIGN PATENT DOCUMENTS

| | | | |
|---|---|---|---|
| JP | 2000064005 | A | 2/2000 |
| JP | 2015193870 | A | 11/2015 |

OTHER PUBLICATIONS

Jun Li, et al., Effect of solution cooling rate on microstructure evolution and mechanical properties of Ni-based superalloy ATI 718Plus, Materials Science & Engineering A, 2021, pp. 1-13, vol. 812, 141113.

* cited by examiner

VACUUM SOLUTION AND AGING TREATMENT PROCESS FOR IMPROVING HIGH-TEMPERATURE PLASTICITY OF GH4738 RINGS

TECHNICAL FIELD

The present invention belongs to the technical field of heat treatment of nickel-based superalloys, and particularly relates to a vacuum solution and aging treatment process for improving high-temperature plasticity of GH4738 rings.

BACKGROUND

High-temperature alloys, also referred to as superalloys, have high strength, excellent corrosion and oxidation resistance, good fatigue property and microstructure stability, and are mainly applied in the manufacturing of important parts serving at high-temperature ends on aeroengines and gas turbines. GH4738 is a γ'-phase precipitation hardened wrought superalloy, the service temperature of which is up to 800° C. to 900° C. owing to the large amount of alloying elements such as Co, Cr, and Mo. The remarkable advantage of this superalloy is its good formability at high temperature, so it is a good candidate for the production of high-temperature components with complex shapes such as rings for combustion chambers. Superalloy rings serving under extreme conditions will subjecte to high temperature, high stress and strong vibration simultaneously, so the material is required to have excellent high-temperature plasticity. In addition, the superalloy rings will be subjected to deformation because of high temperatures in the production process. Considering the characteristics of high alloying degree, high deformation resistance, and narrow machinable area of GH4738 superalloy, improper control of process parameters can lead to the cracking of the alloy being machined and the scrapping of a workpiece. Therefore, a higher requirement is put forward for the plasticity of GH4738 superalloy at high temperature.

It should be noted that the control of the mechanical properties of the GH4738 superalloy is mainly realized by adjusting sizes and contents of precipitates such as γ' phase and carbides, wherein the grain interior is mainly strengthened by coherent γ' precipitates with $Ni_3(Al, Ti)$ face-centered cubic structure and the grain boundary is mainly strengthened by precipitation of the $M_{23}C_6$ carbides. The high-temperature plasticity of a superalloy is jointly determined by the distribution characteristics of intragranular and intergranular precipitates. In the process of superalloy machining, the distribution of the precipitated phases is often changed by controlling parameters of solution and aging treatments, so that the high-temperature plasticity of the superalloy is controlled.

There is a set of standard heat treatment process for the GH4738 superalloy. That is, after solution treatment, the alloy is quickly cooled to room temperature by oil quenching or water quenching to inhibit the precipitation and growth of strengthening phases. Then, the alloy is subjected to standard two stage aging (stabilization at 845° C. and aging at 760° C.) treatment to further optimize the distribution of the strengthening phases. However, in the actual production process of superalloy components, a vacuum solution treatment process is often adopted to prevent surface oxidation. A patent (Patent No. CN109306399A) puts forward a novel heat treatment process based on the standard heat treatment process for the GH4738 superalloy. That is, after the two stage aging treatment, a third step of 730° C. aging treatment is added to give more γ' precipitates and carbides with smaller size and higher dispersion degree, fully strengthening the superalloy and improving the mechanical properties of GH4738 bolt products. However, not only is this heat treatment method tedious in steps and time-consuming, but also the heat treatment process is carried out in the atmospheric environment, without considering vacuum heat treatment conditions.

The cooling rate is low after vacuum solution treatment since the superalloy cannot be taken out quickly, which leads to the precipitation and an increase in the size of the intragranular γ' phase during cooling [Li J, Ding R, Guo Q Y, et al. Effect of solution cooling rate on microstructure evolution and mechanical properties of Ni-based superalloy ATI 718Plus, Mat. Sci. Eng. A, 2021, 812: 141113.]. If the standard two stage aging treatment is still adopted in subsequent aging treatment, the size of the γ' precipitates in the alloy matrix will be too large, leading to a low plasticity index. Therefore, after the vacuum solution temperature of the superalloy is determined, it is necessary to optimize the microstructure of the superalloy by improving the solution and aging process and develop a heat treatment process suitable for GH4738 rings with high requirements on surface quality and high-temperature plasticity. However, so far, no related heat treatment process research has been found in China yet.

SUMMARY

The object of the present invention is to develop a vacuum solution and aging treatment process for improving high-temperature plasticity of GH4738 rings, so as to ensure that GH4738 rings have excellent high-temperature plasticity within a temperature range from 540° C. to 760° C. This process is applicable to GH4738 rings which have a high requirement on high-temperature plasticity after heat treatment.

In order to achieve the aforementioned object of the present invention, the present invention adopts the following technical solution:

The vacuum solution and aging treatment process for improving high-temperature plasticity of GH4738 rings includes the following steps:

(Step 1) putting a formed GH4738 ring into a vacuum furnace, and vacuumizing the furnace to less than $4\times10^{-2}$ Pa;

(Step 2) heating the alloy treated in Step 1 to a solution temperature of 1020° C. to 1030° C. which is kept for 30 minutes to 60 minutes, and then injecting nitrogen to cool the alloy to room temperature;

(Step 3) putting the alloy treated in Step 2 into a furnace, heating the alloy to an aging temperature of 740° C. to 750° C. along with the furnace, and then after the temperature is kept for 30 hours to 35 hours, taking out and cooling the alloy to room temperature.

Further, in Step 2 and Step 3, the alloy is heated to the target temperatures along with the furnaces at a rate of 5° C/min to 10° C/min.

Furthermore, in Step 2, the cooling rate of the alloy is controlled in a range from 40° C/min to 80° C/min when nitrogen is injected for cooling.

Compared with the prior art, the present invention has the beneficial technical effects:

According to the present invention, nitrogen is directly injected for cooling after vacuum solution treatment, and the cooling rate of the superalloy is controlled in a range from 40° C/min to 80° C/min during cooling. This cooling process increases the cooling rate after solution treatment, ensuring a high nucleation rate of the γ' precipitates and the intergranular $M_{23}C_6$ carbides and inhibiting the precipitation and growth of the precipitate phases to a certain degree. Afterwards, the alloy is treated with the low aging temperature of 740° C. to 750° C. for 30 hours to 35 hours, promoting the uniform and sufficient precipitation of the intragranular γ' precipitates and the intergranular $M_{23}C_6$ carbides after aging treatment.

The high-temperature plasticity of the superalloy ring treated by adopting this process is significantly increased, while the strength is not decreased. The elongation and area reduction of the superalloy ring stretched at 540° C. after heat treatment are 30% and 34% respectively, which are 25% and 36% higher than those before process optimization respectively. The elongation and area reduction of the superalloy ring stretched at 760° C. are 49% and 70% respectively, which are 32% and 27% higher than those before process optimization respectively.

DETAILED DESCRIPTION OF THE EMBODIMENTS

Figure 1:
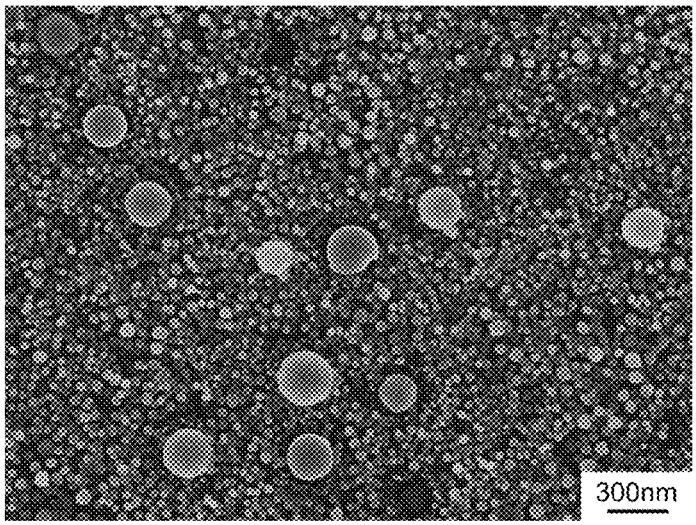
FIG. 1 is the distribution of γ' precipitates in the GH4738 superalloy treated by vacuum solution and aging according to Example 1.
Figure 2:
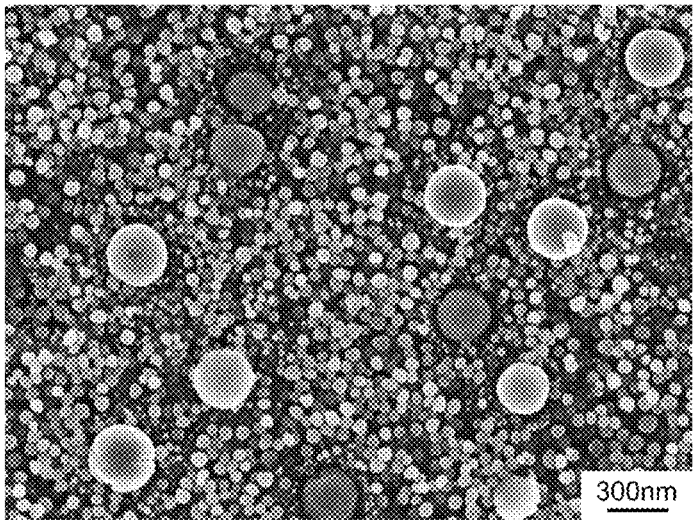
FIG. 2 is the distribution of γ' precipitates in the GH4738 superalloy treated by vacuum solution and conventional two stage aging according to Comparative Example 1.

The present invention will be further illustrated in detail with reference to the following specific examples, which are illustrative rather than limitative for the present invention. The alloys in the examples and the comparative examples are specifically GH4738 rings with sectional dimensions of 40*20 mm made from the same batch of materials, the components of which are shown in the following table.

TABLE 1

Components of GH4738 Superalloy Used in Examples and Comparative Examples

| Component | C | Cr | Co | Mo | Ti | A1 | Zr | B | Ni |
|---|---|---|---|---|---|---|---|---|---|
| Content wt. % | 0.05 | 18.90 | 13.55 | 3.80 | 3.20 | 1.55 | 0.05 | 0.007 | The balance |

Example 1

After being hot-wrought, the GH4738 ring was first machined to achieve the precise control of final size and remove the oxide layer formed in the process of hot working. The pretreated GH4738 ring was put into a vacuum furnace, and the furnace was vacuumized to lower than $4\times10^{-2}$ Pa.

The alloy was heated to a solution temperature of 1030° C. along with the furnace at a rate of 8° C/min, with the temperature being kept for 60 minutes, and nitrogen was then injected to cool the alloy to room temperature at a rate of 50° C/min.

The alloy was heated to an aging temperature of 750° C. along with the furnace at a rate of 10° C/min, and after the temperature was kept for 35 hours, the alloy was taken out and air-cooled to room temperature.

Comparative Example 1

After being hot-wrought, the GH4738 ring was first machined to achieve the precise control of final size and remove the oxide layer formed in the process of hot working. The pretreated GH4738 ring was put into a vacuum furnace, and the furnace was vacuumized to lower than $2\times10^{-2}$ Pa.

The alloy was heated to a solution temperature of 1030° C. along with the furnace at a rate of 8° C/min, with the temperature being kept for 30 minutes, and afterwards, the alloy was first cooled to 900° C. in the furnace and then to less than 80° C. at a rate of 30° C/min.

The alloy was heated to a stabilization treatment temperature of 845° C. along with the furnace at a rate of 10° C/min, and after the temperature was kept for 4 hours, the alloy was then taken out and air-cooled to room temperature; the alloy was heated to an aging treatment temperature of 760° C. along with the furnace at a rate of 10° C/min, and after the temperature was kept for 16 hours, the alloy was taken out and air-cooled to room temperature.

TABLE 2

Test Result of Tensile Property of Alloy in Example 1

| | Tensile Strength MPa | | Yield Strength MPa | | Elongation at Break % | | Reduction of Area % | |
|---|---|---|---|---|---|---|---|---|
| | 540° C. | 760° C. | 540° C. | 760° C. | 540° C. | 760° C. | 540° C. | 760° C. |
| Example 1 | 1211 | 850 | 755 | 689 | 30 | 49 | 34 | 70 |
| Comparative example 1 | 1202 | 853 | 748 | 695 | 24 | 37 | 25 | 55 |

Example 2

After being hot-wrought, the GH4738 ring was first machined to achieve the precise control of final size and remove the oxide layer formed in the process of hot working. The pretreated GH4738 ring was put into a vacuum furnace, and the furnace was vacuumized to lower than $10^{-3}$ Pa.

The alloy was heated to a solution temperature of 1020° C. along with the furnace at a rate of 10° C/min, with the temperature being kept for 40 minutes, and nitrogen was then injected to cool the alloy to room temperature at a rate of 60° C/min.

The alloy was heated to an aging temperature of 745° C. along with the furnace at a rate of 8° C/min, and after the temperature was kept for 30 hours, the alloy was taken out and air-cooled to room temperature.

TABLE 3

Test Result of Tensile Property of Alloy in Example 2

| | Tensile Strength MPa | | Yield Strength MPa | | Elongation at Break % | | Reduction of Area % | |
|---|---|---|---|---|---|---|---|---|
| | 540° C. | 760° C. | 540° C. | 760° C. | 540° C. | 760° C. | 540° C. | 760° C. |
| Example 2 | 1194 | 863 | 756 | 698 | 32 | 48 | 36 | 69 |
| Comparative example 1 | 1202 | 853 | 748 | 695 | 24 | 37 | 25 | 55 |

The uniformity of the microstructure is one of the main factors affecting the plasticity of a superalloy. Adjusting the uniformity of the distribution of γ' precipitates by optimizing the parameters of the heat treatment process is an important means to increase the plasticity of the GH4738 superalloy as a γ' precipitation hardened alloy. According to the present invention, after vacuum solution treatment, a high cooling rate is adopted to increase the nucleation rate of the γ' precipitates, and meanwhile, the uniformly distributed γ' precipitates is obtained by long-time treatment at a low aging temperature of 740° C. to 750° C., so that the high-temperature plasticity of the alloy is increased. Because the carbide is hard and brittle and has an incoherent relationship with the matrix, the large-sized intergranular carbides will precede to become a crack source during hot working of superalloys, and as a result, alloy plasticity is decreased. According to the present invention, by increasing the cooling rate of the superalloy ring after solution treatment, the aggregation and growth of the large-sized $M_{23}C_6$ carbides are prevented.

Besides the aforementioned embodiments, the present invention can also have other embodiments. All technical solutions adopting equivalent substitutions or equivalent transformation forms shall fall within the claimed protection scope of the present invention.

What is claimed is:

1. A vacuum solution and aging treatment process for improving a high-temperature plasticity of GH4738 rings of 540° C. to 760° C., comprising the following steps:

step 1: putting a formed GH4738 ring into a vacuum furnace and vacuumizing the vacuum furnace to lower than $4\times10^{-2}$ Pa to obtain an alloy;

step 2: heating the alloy treated in the step 1 to a solution temperature of 1020° C. to 1030° C., keeping the solution temperature for 30 minutes to 60 minutes, and then injecting nitrogen to cool the alloy to a room temperature;

step 3: putting the alloy treated in the step 2 into a furnace, heating the alloy to an aging temperature of 740° C. to 750° C. along with the furnace, and after the aging temperature is kept for 30 hours to 35 hours, taking out the alloy and cooling the alloy to the room temperature;

wherein in the step 2, a cooling rate of the alloy is controlled in a range from 40° C/min to 80° C/min when the nitrogen is injected for cooling.

2. The vacuum solution and aging treatment process for improving the high-temperature plasticity of the GH4738 rings of 540° C. to 760° C. according to claim 1, wherein in the step 2 and the step 3, the alloy is heated to a target temperature along with the furnace at a rate of 5° C/min to 10° C/min.

* * * * *